United States Patent [19]

Skovdal

[11] Patent Number: 4,520,832

[45] Date of Patent: Jun. 4, 1985

[54] VAPOR GENERATING HAIR ROLLER ASSEMBLY

[75] Inventor: Jorgen Skovdal, Trumbull, Conn.

[73] Assignee: Clairol Incorporated, New York, N.Y.

[21] Appl. No.: 461,811

[22] Filed: Jan. 28, 1983

[51] Int. Cl.[3] ..... A45D 2/12

[52] U.S. Cl. ..... 132/33 R; 132/36 R; 132/37 R

[58] Field of Search ..... 132/33 R, 36, 37 R

[56] References Cited

U.S. PATENT DOCUMENTS

| | | | |
|---|---|---|---|
| 1,665,619 | 4/1928 | Ackley | 132/33 R |
| 2,156,687 | 5/1939 | Grabner | 132/33 R |
| 2,325,799 | 8/1943 | Pountain | 132/33 R |
| 4,029,110 | 6/1977 | Hyland | 132/33 R |

*Primary Examiner*—Gregory E. McNeill

*Attorney, Agent, or Firm*—Stuart E. Krieger

[57] ABSTRACT

A vapor generating roller assembly includes a hollow perforated roller with a heatable inner surface surrounding a bore. A device which is removably insertable into the bore provides the liquid which is vaporized by the heated surface. The vapor is conveyed from the bore through the perforations into a tress of hair wound around the roller.

14 Claims, 14 Drawing Figures

VAPOR GENERATING HAIR ROLLER ASSEMBLY

BACKGROUND OF THE INVENTION

1. Field of the Invention

The present invention relates to hair treatment devices and more particularly to a vapor generating hair roller assembly and its method of use.

2. Description of the Prior Art

Devices are known in the art for producing and applying vapor to a tress of hair. Most of these devices require a source of electricity subsequent to their placement in the hair to produce the heat necessary to generate vapor from the treatment liquid, e.g. U.S. Pat. Nos. 1,652,757 and 1,666,517 to Ackley, U.S. Pat. No. 1,946,813 to Shelton and U.S. Pat. No. 3,839,292 to Walter et al.

In U.S. Pat. Nos. 1,919,600 and 1,933,125 to Seward a curling device is disclosed which requires an exothermic chemical reaction to provide the heat necessary to produce the desired vapor.

It is an object of the present invention to provide a device which after placement in the hair does not require either the inconvenience of an outside electrical or steam source, or the materials necessary for an exothermic chemical reaction for the generation of vapor.

It is another object of the present invention to provide a device which can effectively introduce a controlled amount of vapor into a tress of hair.

It is a further object of the present invention to provide a device which includes a roller that is internally heatable to a vapor producing temperature while maintaining an external surface temperature permitting manual insertion into the hair.

It is an additional object of the present invention to provide a device which is relatively inexpensive so as to permit the simultaneous use of a plurality of units for hair treatment.

It is also an object of the present invention to provide a method for effectively using the device for hair treatment.

SUMMARY OF THE INVENTION

These and other objects are accomplished by a vapor generating hair roller assembly which includes a roller having a perforated outer surface suitable for winding a tress of hair therearound. The roller has an externally accessible bore surrounded at least in part by a heatable surface. The bore is in fluid communication with the surface perforations.

A liquid providing member or means, which is insertable into, and removable from the roller, provides liquid at least proximate to the heated surface so as to generate vapor therefrom; the vapor travelling from the bore through the perforations into the tress of hair.

The liquid providing means is preferably a heat resistant structure with liquid absorbent material secured thereto. The bore of the roller is accessible through an open end which is sealed during engagement by the liquid providing means. The vapor, which is produced by exposing fluid retaining absorbent material to the heated surface, is discharged into the tress of hair through the outer surface perforations. The heatable surface may be heated through conduction by mounting the roller through the open end onto a conventional electrical heating post.

BRIEF DESCRIPTION OF THE DRAWINGS

The foregoing and other objects, characteristics and advantages of the present invention will be more clearly understood from the following detailed description when read in conjunction with the accompanying drawings in which.

DESCRIPTION OF THE PREFERRED EMBODIMENTS

Figure 1:
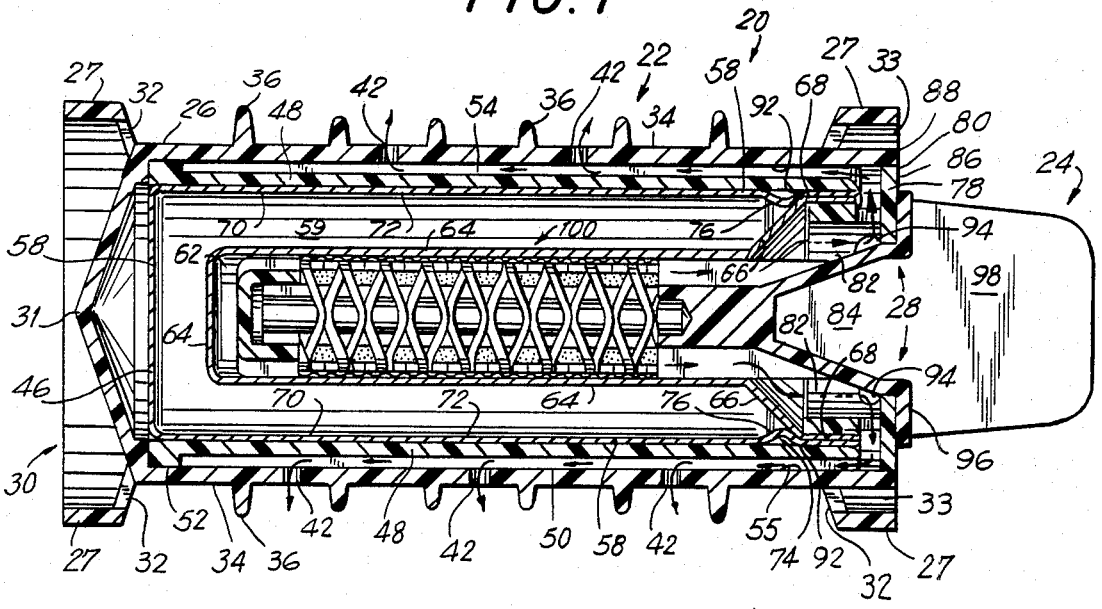
FIG. 1 is a cross-sectional view of a vapor generating roller assembly according to the present invention.

Referring now to FIGS., and in particular FIG. 1, wherein a vapor generating hair roller assembly, generally indicated by the numeral 20, comprises a hollow roller 22 and a liquid providing member of means 24.

The roller 22 includes a hollow tubular member 26 having a circular flange 27 at open end 28 and closed end 30. The open end 28 permits access by the liquid providing means 24 into the interior of the roller 22, and the roller 22 to be mounted on a conventional heating post. The flanges 27 are supported by and spatially offset from the member 26 by radially extending ribs 32 so as to concentrically surround the tubular member 26. Between each pair of adjacent ribs 32 is an aperture 33 which facilitates heat dissipation and cools the flanges 27, so as to permit handling of the roller 22 by the user. The diameter of each of the flanges 27 is larger than that of the tubular member 26 to allow for ease in handling, and to enable spacing of the roller from the scalp for reducing the possibility of user discomfort. The external surface 34 of the tubular member 26 has a hair retaining structure or means such as spades or spikes 36 projecting radially outward therefrom for retaining a tress of hair wound around the roller 22. The tubular member 26, flanges 27 and hair retaining structure 36 are preferably integrally molded from a plastic material such as polypropylene. However, other shapes or types of material, such as aluminum and flocking, may be appropriately utilized for hair retention purposes. Perforations 42 extending through the tubular member 26 and outletting through the external surface 34 permits discharge and distribution of vapor produced within the roller 22 into the tress of hair wound therearound.

Figure 2:
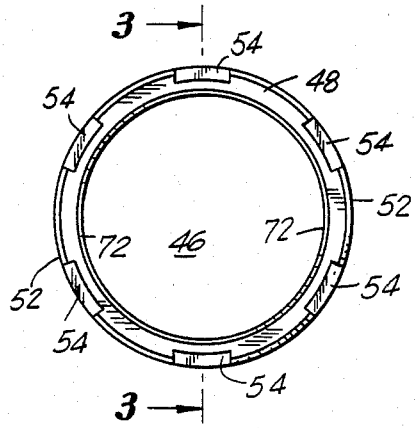
FIG. 2 is an elevational view of the inner shell of the assembly shown in FIG. 1.
Figure 3:
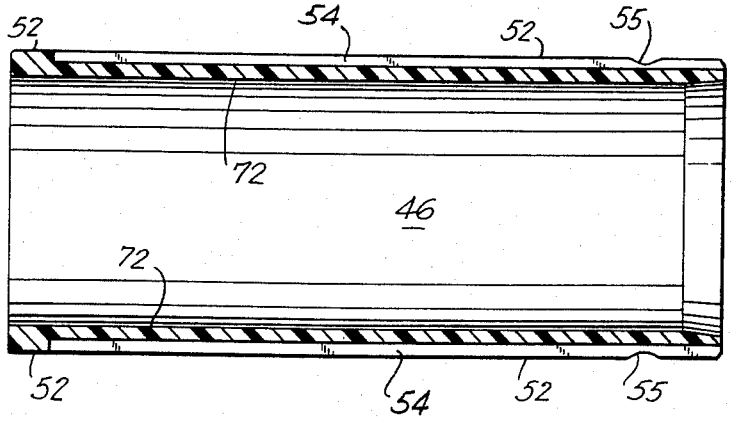
FIG. 3 is a cross-sectional view taken along line 3—3 of FIG. 2.

The tubular member 26 has an open end 28 leading to a centrally disposed chamber 46, and a closed end 30 which tapers to a conical point 31. Within the chamber 46 is a hollow cylindrical inner shell 48, illustrated in FIGS. 1–3, composed preferably of heat conductive material such as aluminum, which abuts the inner surface 50 of the surrounding concentric tubular member 26. Parallel longitudinal vapor conveying channels 54 are grooved into the outer surface 52 of the inner shell 48 and located in registry with the surface perforations 42 so as to provide fluid communication therebetween. Interconnecting adjacent longitudinal vapor channels 54 are notches 55 extending circumferentially in the cylindrical outer surface 52. An alternative embodiment, not shown, has a smooth outer cylindrical surface on the inner shell, with the vapor channels and notches grooved into the inner surface of the tubular member in registry with the perforations.

Within the inner shell 48 is a separate hollow cylindrical cartridge 58 composed of material having high heat conductivity, such as aluminum. An alternative cylindrical cartridge 58 would have the inner shell 48 as an integral part. The cartridge 58 is filled with wax 59 or other appropriate heat absorbing material capable of changing from a solid to liquid state. Alternatively, the cartridge can be solid at all hair treatment temperatures and composed at least in part of heat conductive material, e.g. plastic with metal fillers or solid aluminum. When a solid cartridge is utilized, vapor channels can extend radially directly from the bore through the cartridge to the perforations in the tubular member. The use of a wax filler in the hollow cartridge discourages the construction of steam channels through the cartridge walls. The cartridge 58 has a central bore 62 which is externally accessible through the open end 28. The central bore 62 is surrounded by the enclosure walls 64, sloping sidewall 66 and upper sidewall 68. The enclosure walls 64 are conductively heated when mounted on the heating post. The outer cylindrical walls 70 of the cartridge 58 has a recess 76 which mates with a protrusion 74 directed inwardly from the inner shell 48.

Figure 5:
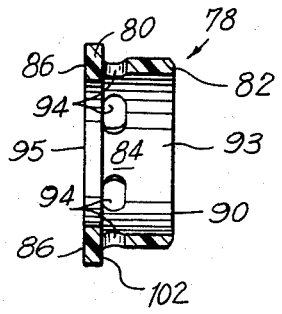
FIG. 5 is a cross-sectional view taken along line 5—5 of FIG. 4.
Figure 4:
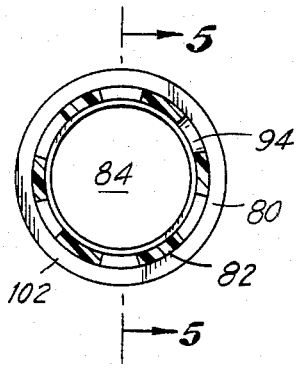
FIG. 4 is a left-side elevational view of the top end cap of the assembly shown in FIG. 1.

A hollow heat resistant cap member 78, composed for example of a plastic such as polyester, is secured within the open end 28 of the roller 22 (FIG. 1). The cap member 78, as shown most clearly in FIGS. 4 and 5, includes a larger diameter top cylindrical portion 80 with a smaller diameter concentric cylindrical portion 82 extending therefrom. A central passageway 84 extends through both portions and is aligned with the cartridge bore 62. The end 90 of the smaller portion 82 annularly abuts the junction 92 of the sloping sidewall 66, and the upper sidewall 68 thereby preventing further entry of the cap member 78 into the chamber 46, while positioning the outer surface 86 of the larger portion 80 flush with the end 88 of the tubular member 26. Circumferentially spaced about the smaller portion 82 are apertures 94 extending radially through the sidewall 93 and interconnecting the central passageway 84 with the vapor channels 54.

Figure 8:
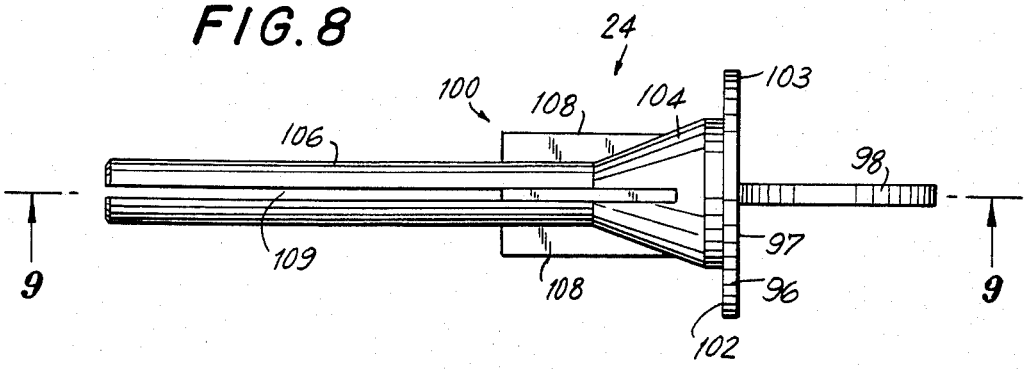
FIG. 8 is a top plan view of the liquid providing member of the assembly of FIG. 1.
Figure 9:
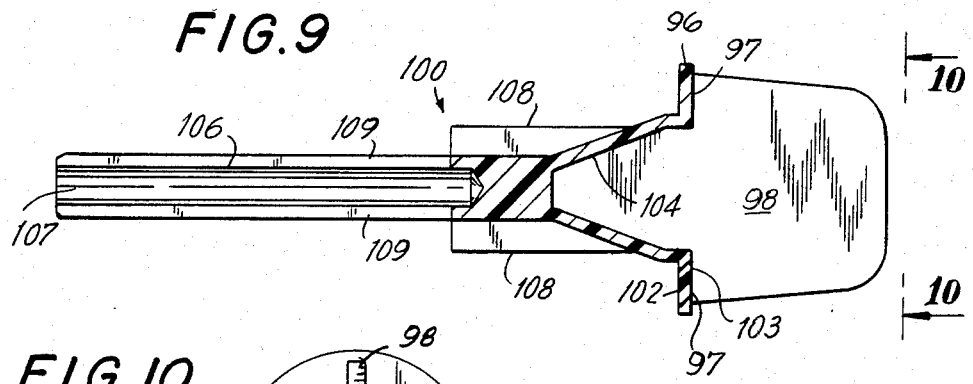
FIG. 9 is a cross-sectional view taken along line 9—9 of FIG. 8.
Figure 10:
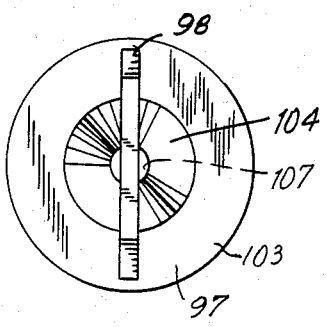
FIG. 10 is a view taken along line 10—10 of FIG. 9.

As shown in FIGS. 1, 8 and 9, the liquid providing means 24, which is insertable into and removable from the cartridge bore 62 through the open end 28 and passageway 84, includes a sealing portion 96, a grasping portion 98, and an insert portion 100. The flat sealing portion 96 is circular with a greater diameter than the passageway opening 95. When the liquid providing means 24 is fully engaged with the roller 22, the lower surface 102 of the sealing portion 96 abuts and overlays the outer surface 97 of the cap member 78 so as to seal the passageway opening 95. At the same time, the grasping portion 98 extends from the upper surface 103 of the sealing portion 96 and extends outwardly from the roller 22 so as to facilitate grasping by the fingers of the user for removal and subsequent insertion of the liquid providing means 24 into the cartridge bore 62.

Figure 7:
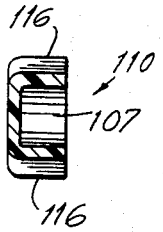
FIG. 7 is a cross-sectional view taken along line 7—7 of FIG. 6.
Figure 6:
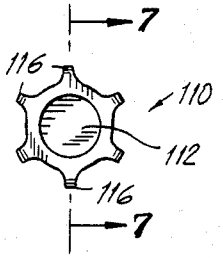
FIG. 6 is a right-side elevational view of the bottom cap of the assembly shown in FIG. 1.

The insertion portion 100, which extends perpendicularly from the bottom surface 102 of the sealing portion 96, includes a frusto-conical segment 104 tapering to a concentric, elongated, hollow, substantially cylindrical support segment 106. The support segment 106 has extending throughout its length a cylindrical bore 107 and a pair of diametrically opposed longitudinal slits 109 interconnected through the bore 107. The sidewalls 93 of the smaller diameter cap member portion 82 is spatially offset from the frustoconical segment 104 so as to permit sequential movement of the vapor produced in the cartridge bore 62 through the passageway 84, apertures 94 in the cap member 78, the vapor channels 54 and surface perforations 42, as indicated by the arrows in FIG. 1. As shown in FIGS. 1, 8 and 9, a first set of radially extending upper vanes 108 are intermittently spaced about the circumference of the upper portion of the insert. These vanes 108 abut the enclosure walls 64 during engagement so as to assure proper centering of the top portion of the insert 100. Referring now to FIGS. 1, 6 and 7, at the base of the insert 100 is a hexagonal cap 110 having a recess 112 for receiving the end of the elongated support segment 106. A second set of vanes 116 extends from the hexagonal corners 118 so as to abut the enclosure walls 64 and provide proper centering of the bottom portion of the insert 100 during engagment. Thus, the two set of vanes 108, 116 provide the insert 100 with a snug fit and proper centering within the cartridge bore 62.

Figure 11:
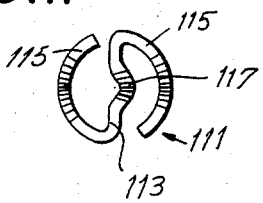
FIG. 11 is a right-side elevational view of the support screen of the assembly of FIG. 1.
Figure 12:
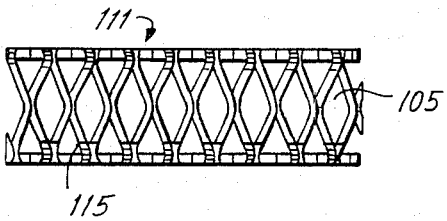
FIG. 12 is a cross-sectional view taken along line 12—12 of FIG. 11.

Referring now to FIGS. 1, 11 and 12, secured to the support segment 106 and extending substantially circumferentially therearound is a wick holder or screen 111 preferably composed of a heat conductive material such as aluminum, having a plurality of openings 105. The screen 111 extends the length of the support segment 106 and has a center branch 113 and two opposing side branches 115. The center branch 113 passes entirely through the segment bore 107, extending through each of the longitudinal slits 109 and has an intermediate curved section 117 for mechanical retention within the bore 107. Each of the side branches 115 extend from an opposing end 111 of the center branch and wraps around approximately one-half of the cylindrical support segment 106. Mounted on and surrounding the screen 111 is a liquid absorbent material or wick 119, such as black polyester felt.

The wick material 119 is preferably chosen for its abilities to hold an excess of a predetermined amount of liquid, to permit vaporization of the held liquid, and to be refillable by immersion in the hair treatment liquid. Curl retention has been found enhanced with the vapor generator hair roller assembly when at least 0.3 grams of water is provided to a tress of hair wound on a small roller and shielded. Larger rollers were found more effective with 0.6 grams of water. Clearly, the size of the roller is a parameter in determining the predetermined minimum amount of vapor required for effective curl retention. Shielding reduces the rate of evaporation of the water vapor from the hair. The preferred black polyester wick material was found to yield 75 to 90% of the absorbed liquid during vaporization.

An appropriate vapor shield (not shown) is one that circumferentially surrounds the tubular member and encloses the tress between the roller and shield, while a longitudinal slit in the shield permits the tress to extend there through from the scalp to the roller. The shield may be attached to the liquid providing means or exist as a separate unit.

Figure 13:
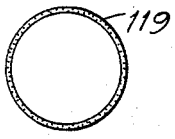
FIG. 13 is a right-side elevational view of the wick tube of the assembly of FIG. 1.
Figure 14:
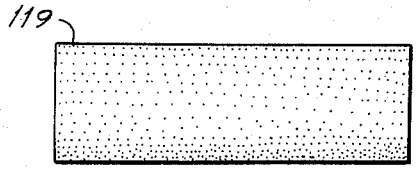
FIG. 14 is a cross-sectional view taken along line 14—14 of FIG. 13.

As shown in FIGS. 13 and 14, the wick material 119 is tubular in shape and mounted circumferentially around the outer surface of the screen 111, so as to come close to or contact the outer concentric heatable enclosure walls 64 during engagement of the roller 12 by the liquid providing means 24. The screen 111 is open at the lateral ends so as to provide a longitudinal passageway between the screen 111 and the support segment 106 which facilitates movement of the vapor to the vapor channels 54. Also, the diamond-shaped screen openings 105 permit escape of the vapor from the wick 119 into the longitudinal passageway.

In the operation of the vapor generating hair roller assembly 20, the roller 22 is mounted through its open end 28 onto a conventional heating post (not shown). The enclosure walls 64 of the cartridge 58 are heated by the post to a temperature in excess of that required for vapor generation. The tubular member 26 may be thermally insulated due to its composition or it can be structurally configured e.g. with splines between the tubular member 26 and cartridge 58, so as to delay heating of the external surface 34 for a time sufficient to permit gripping the roller 12 and inserting it into the hair. Also, the flanged ends 27 are cooled by the rib apertures 33 so to permit the user to grip the flanges 27 for winding a tress of hair around the external surface 34. The liquid providing means 24 is held by the grasping portion 98 and the liquid absorbent material 106 is dipped into the appropriate hair treatment liquid, removed from the liquid and inserted into the cartridge bore 62 of the heated roller 22. The liquid can also be applied to the absorbent material 106 by other means. The liquid is subsequently vaporized by the internal heated enclosure walls 64; the vapor passing from the central bore 62 through the vapor channels 54 and perforations 42 into the tress of hair.

While the invention has been described above with respect to specific embodiments, it should be clear that these embodiments are given by way of example and shall not be deemed as limiting the scope of the invention, except in accordance with the claims hereof.

The invention claimed is:

1. A vapor generating hair roller assembly comprising:

a hollow roller having a perforated outer surface suitable for winding a tress of hair therearound, said roller having an externally accessible bore with a surrounding heatable surface, said bore being in fluid communication with said perforations; and liquid providing means removably insertable into said bore for providing liquid at least proximate to said heatable surface so as to generate vapor therefrom, said vapor outletting through said perforation into the tress of hair.

2. The assembly of claim 1 wherein said bore is accessible through an opening at one end of said roller, said liquid providing means including a heat resistant member, and liquid absorbent material secured to said member, said member sealing said open end for preventing vapor from escaping therethrough.

3. The assembly of claim 2 wherein said absorbent material is capable of providing in excess of a predetermined amount of liquid for vaporization.

4. The assembly of claim 3 wherein said liquid is water and said predetermined amount is 0.3 grams.

5. The assembly of claim 1 wherein said liquid providing means includes a grasping portion to facilitate removal from and insertion into said roller.

6. The assembly of claim 1 wherein said liquid providing means includes a plurality of vanes extending radially therefrom for properly centering and snugly fitting said means within said bore.

7. The assembly of claim 5 wherein said roller is open at one end and said heatable surface is adapted for conductive heating when mounted on a heating post.

8. The assembly of claim 7 wherein said liquid providing means includes a sealing portion having first and second opposing sides, said first side overlapping and sealing said open end, said grasping portion extending perpendicularly from said second side.

9. The assembly of claim 8 wherein said liquid providing means includes an insert portion interconnected with said sealing portion, said insert having a liquid absorbent material secured thereto.

10. The assembly of claim 9 wherein said insert has a porous wire mesh attached thereto, said mesh having a portion offset from said insert to permit vapor movement therebetween, said liquid absorbent material being mounted on said mesh.

11. The assembly of claim 1 wherein said roller includes a cartridge composed at least in part of a heat conductive material, said bore extending at least partly into said cartridge.

12. The assembly of claim 8, said cartridge having inner heatable walls at least partly surrounding said bore and substantially concentric outer walls, a chamber being defined between said inner and outer walls containing a wax material.

13. The assembly of claim 9 wherein said roller includes a tubular outer member, an inner shell disposed between said cartridge and said outer member, said inner shell and outer member forming at least one vapor channel therebetween, said channel receiving vapor from liquid vaporized in said bore and for transfer therethrough to said perforations.

14. The assembly of claim 13 wherein said inner shell is an integral part of said cartridge.

* * * * *